US007210958B1

(12) United States Patent
Jacques et al.

(10) Patent No.: US 7,210,958 B1
(45) Date of Patent: May 1, 2007

(54) ELECTRICAL CONTACT CRIMP EAR SERRATION

(75) Inventors: Ralph E. Jacques, Sarasota, FL (US); Dennis Herdegen, Sarasota, FL (US); John J. MacNeil, Valrico, FL (US); Edward Jacques, Sarasota, FL (US); Brian J. Stumm, Saunderstown, RI (US)

(73) Assignee: ETCO, Inc., Warwick, RI (US)

( * ) Notice: Subject to any disclaimer, the term of this patent is extended or adjusted under 35 U.S.C. 154(b) by 0 days.

(21) Appl. No.: 11/312,946

(22) Filed: Dec. 20, 2005

(51) Int. Cl.
*H01R 4/10* (2006.01)

(52) U.S. Cl. ..... 439/421; 439/877

(58) Field of Classification Search ..... 439/421, 439/877, 878–882
See application file for complete search history.

(56) References Cited

U.S. PATENT DOCUMENTS 2,854,648 A 9/1958 Berg
3,510,829 A * 5/1970 Keller ..... 439/421
3,549,786 A 12/1970 Kuo
3,650,706 A * 3/1972 Parsons ..... 428/51
3,735,331 A 5/1973 O'Donnell et al.
3,761,872 A 9/1973 Ebinger
3,812,448 A 5/1974 Haitmanek
3,947,082 A 3/1976 Bender
3,989,339 A 11/1976 Haitmanek
5,385,483 A * 1/1995 Lin ..... 439/424
5,522,739 A * 6/1996 Axelsson ..... 439/730
6,749,457 B2 6/2004 Sakaguchi et al.

OTHER PUBLICATIONS

Thomas & Betts, Dragon Tooth Insulation Piercing Connectors for Magnetic Wire, 2002.

* cited by examiner

*Primary Examiner*—Hien Vu
(74) *Attorney, Agent, or Firm*—Altman & Martin; Steven K. Martin

(57) ABSTRACT

An electrical contact crimp ear serration comprised of a plurality of teeth where each tooth has a cross-sectional profile comprising a leading face extending upwardly to an apex from the crimp ear surface, a central face extending downwardly from the apex to a valley below the crimp ear surface, and a trailing face extending upwardly from the valley to the crimp ear.

4 Claims, 6 Drawing Sheets

ELECTRICAL CONTACT CRIMP EAR SERRATION

CROSS-REFERENCES TO RELATED APPLICATIONS

Not Applicable

STATEMENT REGARDING FEDERALLY SPONSORED RESEARCH OR DEVELOPMENT

Not Applicable

REFERENCE TO A SEQUENCE LISTING, A TABLE, OR A COMPUTER PROGRAM LISTING COMPACT DISK APPENDIX

Not Applicable

BACKGROUND OF THE INVENTION

1. Field of the Invention

The present invention relates to electrical contacts, more particularly, to methods of manufacturing crimp ears.

2. Description of the Related Art

The typical electrical contact has a contact portion and a crimp ear for attaching a wire. The inner surface of the open barrel or closed barrel crimp ear is serrated to provide a more secure wire attachment, where the serration may take the form of grooves or ridges. The simplest form is a groove that extends laterally across the face of the crimp ear to indent and clinch the outer layers of multi-stranded or single bare wire. Other forms are known in the art for providing a better bare wire connection or that pierce insulation.

A number of different serration cross-sectional profiles are known in the art. U.S. Pat. No. 3,549,786, issued to Kuo, discloses a serration that rises from a base below the crimp ear surface to a sharp edge above the crimp ear surface. The profile has a flat face perpendicular to the crimp ear surface and a face that curves downwardly and outwardly from the sharp edge. U.S. Pat. No. 3,735,331, issued to O'Donnell et al., discloses a groove below the surface of the crimp ear. The profile has a face that slopes into the groove and slightly away from the center of the groove and another face the slopes into the groove and substantially toward the center of the groove. U.S. Pat. No. 3,812,448, issued to Haitmanek, discloses a serration with several different profiles. The common thread is that one face extends upwardly from the crimp ear surface while the other face extends upwardly from below the crimp ear surface. The two faces meet at a point.

BRIEF SUMMARY OF THE INVENTION

An object of the present invention is to provide a crimp ear serration that provides a secure electrical and mechanical attachment to a bare single or a multi-stranded bare wire.

The present invention is a serration for use on an electrical contact crimp ear. The serration is comprised of numerous teeth, each with an apex and a valley formed in the crimp ear surface. The arrangement of the teeth to form the serration depends upon the particular application.

The basic profile of the tooth is a saw tooth. A leading face ramps upwardly to an apex. From the apex, a central face extends downwardly to a valley below the crimp ear surface. A trailing face ramps up to the crimp ear surface. There may be a gap between the trailing face and the leading face of adjacent teeth. Preferably, the gap is minimized by adding rows of teeth if necessary.

Other objects of the present invention will become apparent in light of the following drawings and detailed description of the invention.

BRIEF DESCRIPTION OF THE DRAWINGS

For a fuller understanding of the nature and object of the present invention, reference is made to the accompanying drawings, wherein.

DETAILED DESCRIPTION OF THE INVENTION

Figure 1:
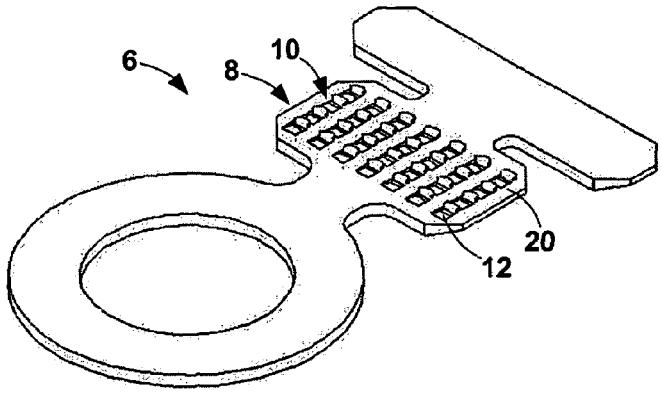
FIG. 1 is a drawing of an electrical contact with a crimp ear provided with a configuration of the serration of the present invention.
Figure 4:
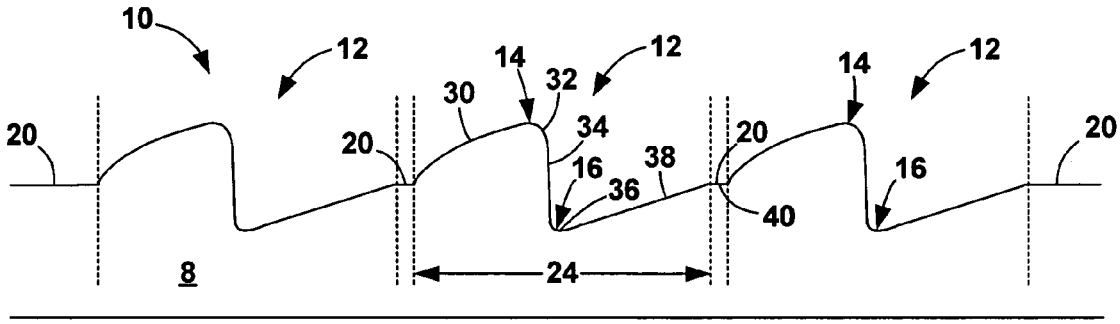
FIG. 4 is the cross-sectional profile of the crimp ear serration of FIG. 1 along the line 4—4.

The present invention is a crimp ear serration 10 for use on the crimp ear 8 of an electrical contact 6. The serration 10 is comprised of numerous teeth 12, as shown in FIG. 1. As seen in FIG. 4, each tooth 12 has an apex 14 and a valley 16 (collectively, features) formed in the nominal surface 20 of the crimp ear 8, that is, the plane of the surface of the crimp ear 8 prior to formation of the serration 10. The number, size, and position of the teeth 12 vary depending on the particular application. The serration 10 can be used as an alternative to conventional serrations on many types of electrical connectors.

Figure 2:
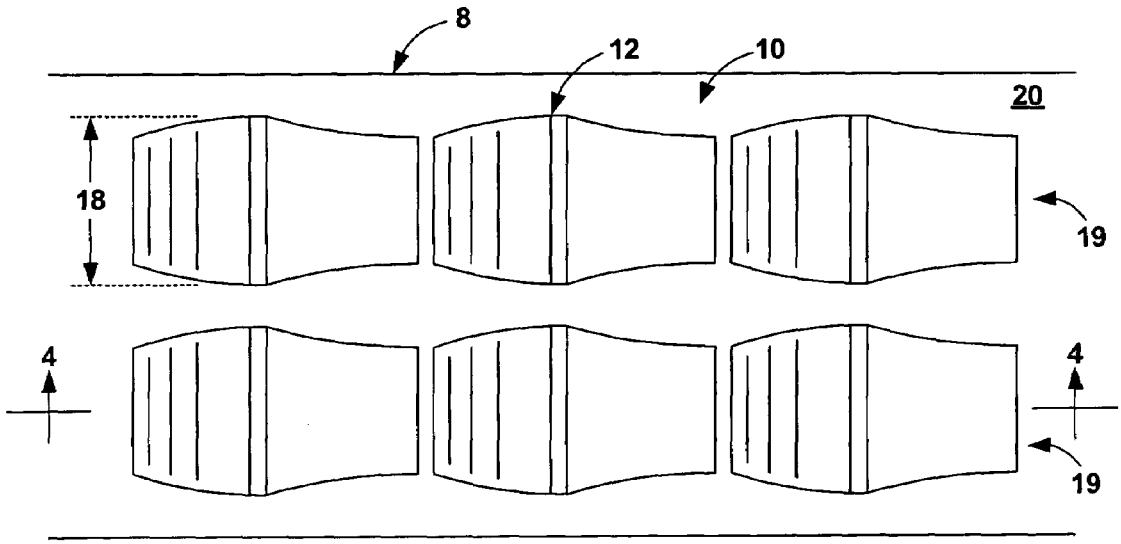
FIG. 2 is an enlarged schematic of a crimp ear provided with one configuration of the serration of the present invention.
Figure 3:
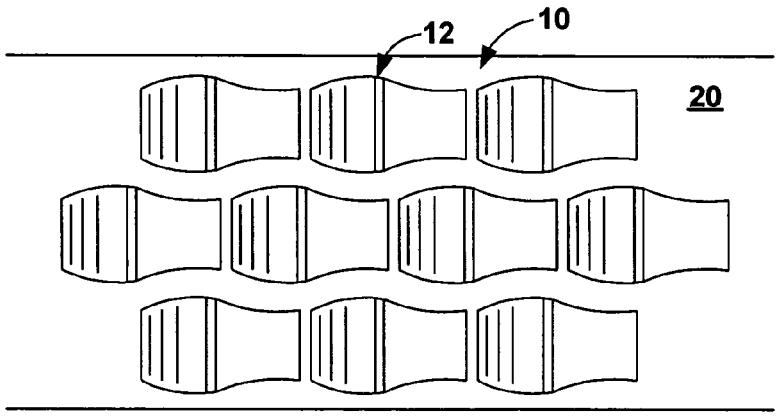
FIG. 3 is an enlarged schematic of a crimp ear provided with another configuration of the serration of the present invention.
Figure 5:
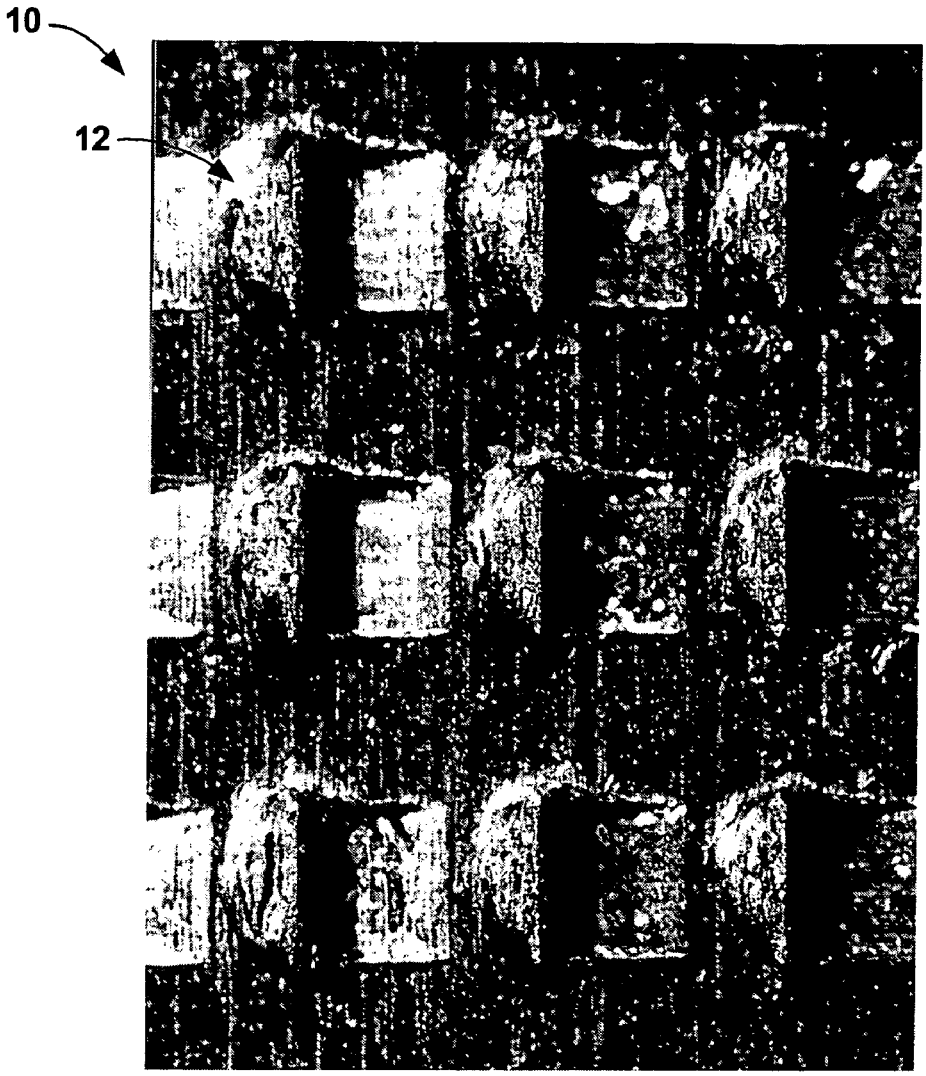
FIG. 5 is a photograph of a crimp ear provided with the serration of the present invention.

FIGS. 2, 3, and 5 show two configurations of how the teeth 12 can be arranged to form the serration 10 on the crimp ear 8. In FIGS. 2 and 5, the teeth 12 are arranged in aligned horizontal rows 19. In FIG. 3, the teeth 12 are arranged in staggered horizontal rows. The present invention contemplates the use of any arrangement of teeth 12 that is suitable for the intended use. Further, the present invention does not intend that it be limited to any length 18 for the teeth 12. The present figures show a relatively short tooth 12. The present invention contemplates, however, that the tooth 12 may be long enough to extend completely across the face of the crimp ear surface 20.

Figure 6:
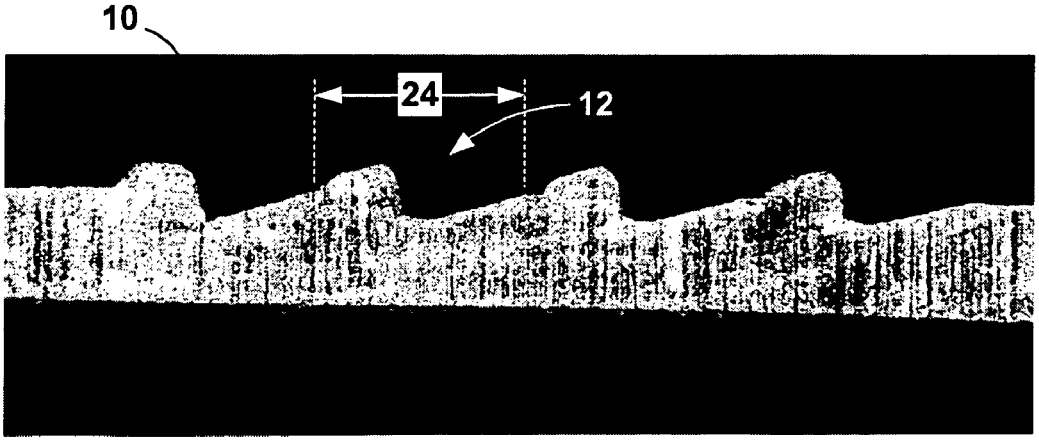
FIG. 6 is a photograph of the cross-sectional profile of the teeth of FIG. 4.

The basic profile shape of the tooth 10 is that of a saw tooth, as can be seen in the schematic of FIG. 4 and the photograph of FIG. 6, and spans length 24. From left to right, a leading face 30 starts upwardly from the nominal crimp ear surface 20 and curves slightly toward horizontal, for an average angle of about 18 to 28 degrees from the nominal surface 20. At the apex 14, it curves sharply downwardly, as at 32, to a central face 34, which is at an average angle of about 82 to 90 degrees from the nominal surface 20. The central face 34 is more than twice the height that the apex 14 is from the nominal surface 20, which means that the central face 34 ends in a valley 16 below the nominal surface 20 at a depth of more than the height of the apex. From the valley 16, it curves upwardly, as at 36, to a trailing face 38, that ramps upwardly to the nominal surface 20 at an average angle of about 10 to 18 degrees from horizontal. Alternatively, the valley curve 36 may be very sharp, with little or no radius.

FIG. 4 shows that there is a gap 40 between adjacent teeth 12 that is short relative to the length of each tooth 12. However, the present invention contemplates that the gap 40 may be any length. There may be no gap, that is, the teeth 12 abut or even overlap each other, or the gap 40 may be larger relative to the length of the teeth 12. The preference is to keep the gap to a minimal size. Thus, so rather than increasing the spacing for larger crimp ears, the preference is to add additional rows of teeth and keep the gap to a minimum.

Table I lists typical dimensions for the various surfaces of a tooth 12 designed for wire sizes ranging from 22 AWG to 10 AWG. The table lists the reference numerals in FIG. 4 and the corresponding ranges of dimensions. The dimensions can vary proportionately depending upon the intended size of the tooth 12.

TABLE I

| Reference Numeral | Dimension |
|---|---|
| 24 | 25–30 mils |
| 30 | 8–12 mils length with an 18°–28° slope |
| 32 | 2–3 mils radius |
| 34 | 6–10 mils with an 82°–90° slope |
| 36 | 0–4 mils radius |
| 38 | 18–22 mils length with a 10°–18° slope |
| 40 | 0–30 mils |

The serration 10 of the present invention has several advantages when compared to the industry standard serration consisting of parallel grooves that extend laterally across the face of the crimp ear. First, the apexes 14 and valleys 16 of the serration 10, being both below and above the crimp ear surface 20, cause deformation to the wire material as it conforms to the shape of the crimp ear serration. This deformation increases the surface contact area between the joining materials, thus improving both the electrical and mechanical connections.

Also, the profile of the present invention results in no loss of material mass, whereas the industry standard serration has a reduction in material mass due to forming a groove in the crimp ear surface. This reduction in material mass could be significant as the crimp height approaches the maximum crimp height limits.

Figure 7A:
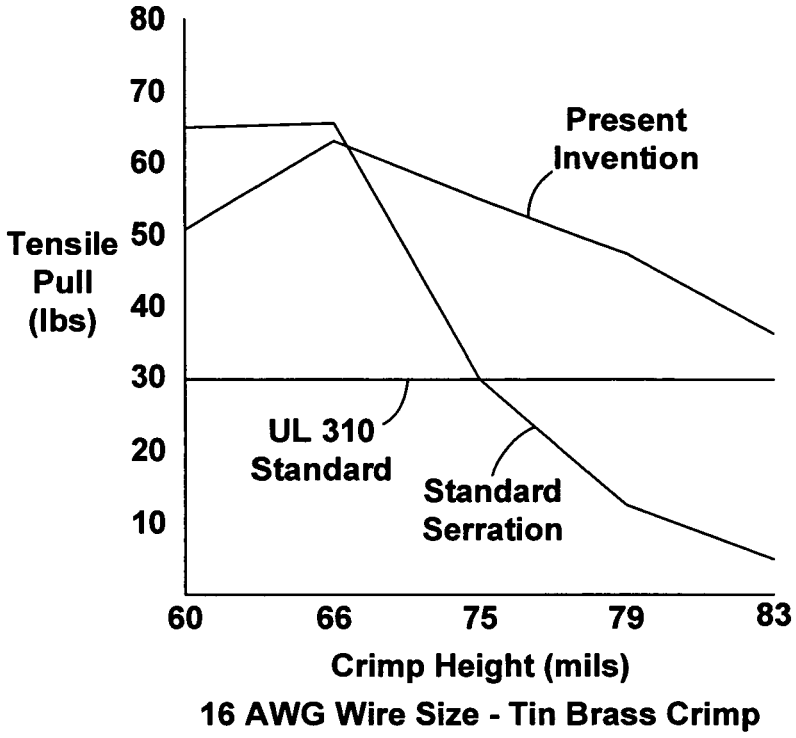
FIGS. 7A–7C are graphs comparing the serration of the present invention with the industry standard using 16 AWG wire.
Figure 7B:
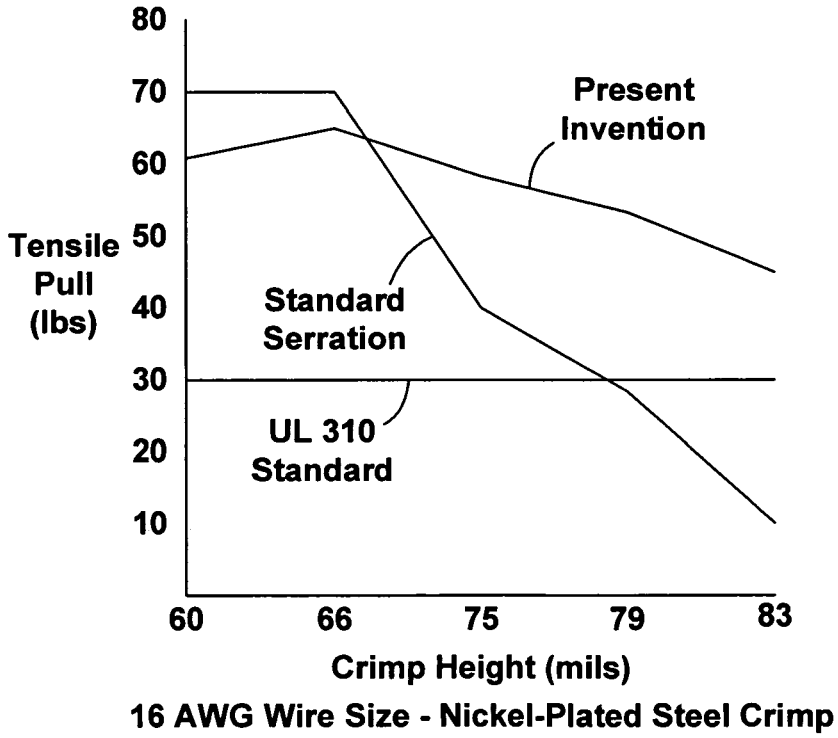
Figure 7C:
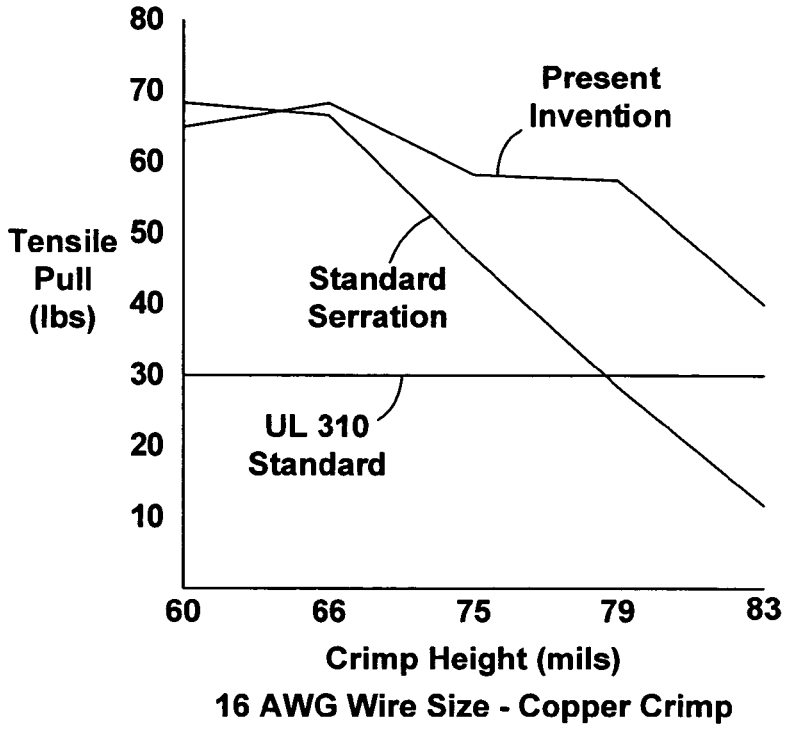
Figure 8A:
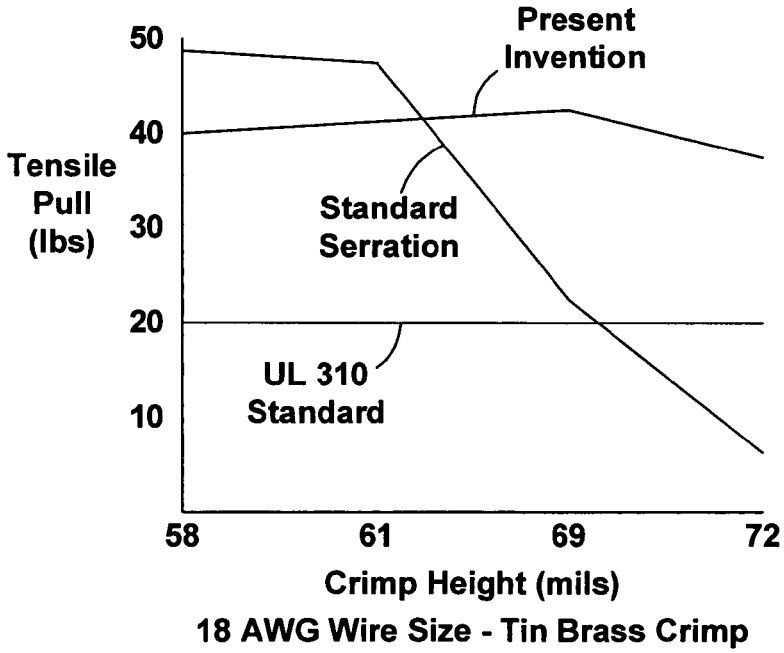
FIGS. 8A–8C are graphs comparing the serration of the present invention with the industry standard using 18 AWG wire.
Figure 8B:
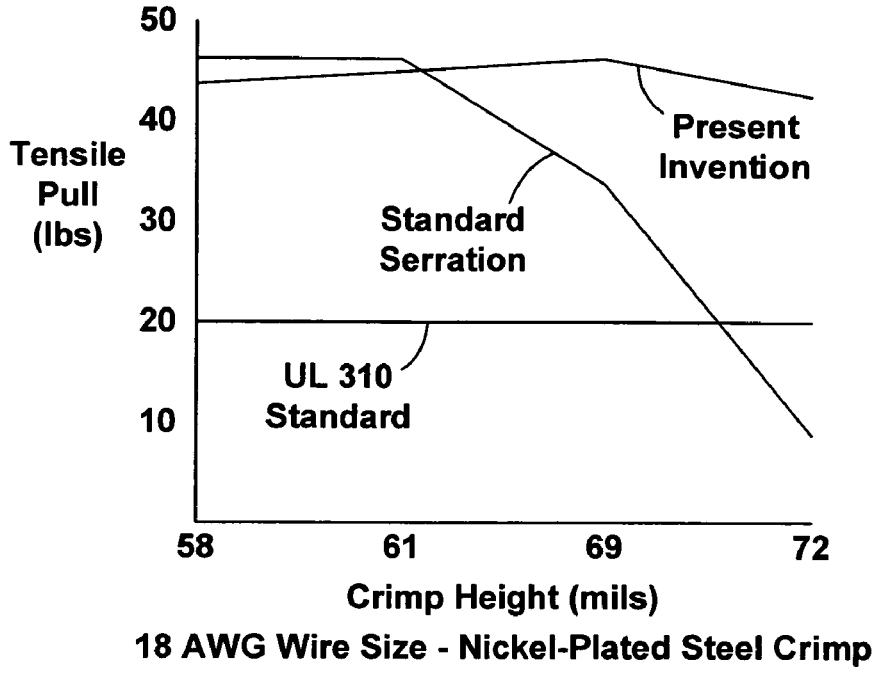
Figure 8C:
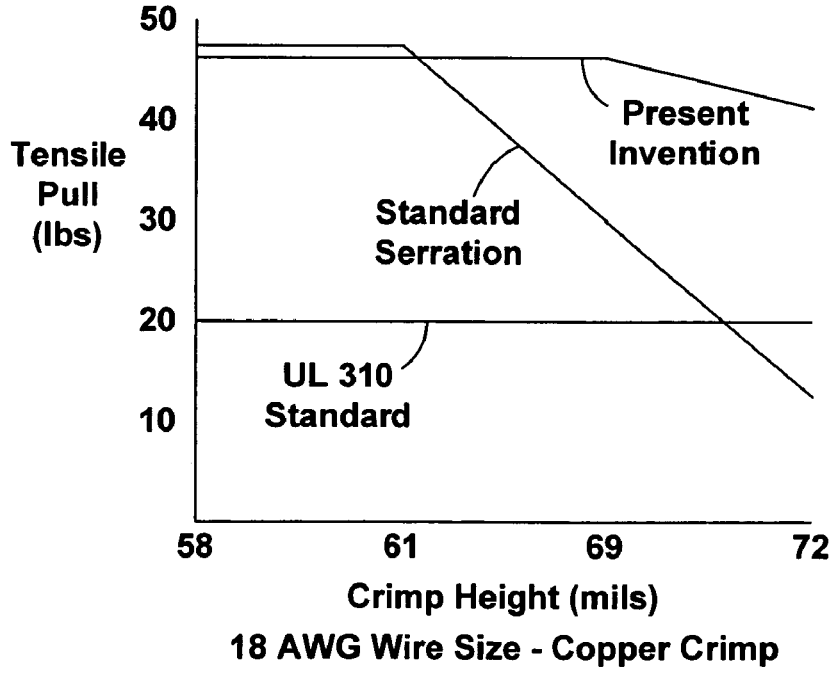

Further, testing under the guidelines of UL standards 310 and 486A show that the serration 10 of the present invention is superior through a broader range of crimp heights than the industry standard serration. FIGS. 7A–7C and 8A–8C show graphical test data comparing a crimp employing the serration 10 of the present invention to the industry standard serration. The tests were conducted with three different standard crimp materials (tin brass, nickel-plated steel, and copper) using two different wire sizes. FIGS. 7A–7C show test results for 16 AWG wire and FIGS. 8A–8C show test results for 18 AWG wire. In general, for smaller crimp heights, the serration 10 of the present invention is comparable to the industry standard. For larger crimp heights, the test date show that the serration 10 of the present invention is significantly stronger than the industry standard serration.

The test data show that the serration 10 of the present invention is less sensitive to variations in the crimping or attaching process. The protruding features of the serration provide greater deformation to the conductor at broader crimp height ranges. The typical crimp height range is +/−2 mils. The serration allows an upward shift +2 mils of the nominal crimp height settings, combined with a broader crimp height range of +/−4 mils. Less crimping force is required to provide a good crimp, resulting in less wear and tear to assembly and application equipment.

The dimensional and visual qualities of the contact are improved. No coining or swaging is required to form the serration 10, which virtually eliminates material growth and work hardening.

Thus it has been shown and described a crimp ear serration, which satisfies the objects set forth above.

Since certain changes may be made in the present disclosure without departing from the scope of the present invention, it is intended that all matter described in the foregoing specification and shown in the accompanying drawings be interpreted as illustrative and not in a limiting sense.

We claim:

1. A serration for an electrical contact crimp ear having a nominal surface with a flat surface, said serration comprised of a plurality of teeth, each of said teeth having a cross-sectional profile comprising:

(a) a leading face extending upwardly from said nominal surface to a rounded apex at an average angle of between approximately 18° and 28° to said nominal surface, said apex having a height from said nominal surface;

(b) a central face extending downwardly from said apex and past said nominal surface to a valley at an average angle of between approximately 82° and 90° to said nominal surface, said valley having a depth from said nominal surface that is greater than said apex height; and (c) a trailing face extending upwardly from said valley to said nominal surface at an average angle of between approximately 12° and 18° to said nominal surface.

2. The serration profile of claim 1 wherein said leading face is approximately 8 to 12 mils long, said apex has a radius of approximately 2 to 3 mils, said central face is approximately 6 to 10 mils long, said valley has a radius of approximately 0–4 mils, and said trailing face is approximately 18 to 22 mils long.

3. The serration profile of claim 1 wherein said trailing face of a first of said teeth is adjacent to said leading face of a second of said teeth with a gap therebetween.

4. The serration profile of claim 1 wherein said trailing face of a first of said teeth is adjacent to said leading face of a second of said teeth with no gap therebetween.

* * * * *